US005860647A

United States Patent [19]

Ikesue

[11] Patent Number: 5,860,647

[45] Date of Patent: Jan. 19, 1999

[54] PAPER DISCHARGE DEVICE AND STORING UNIT FOR IMAGE FORMING APPARATUS

[75] Inventor: Masumi Ikesue, Tokyo, Japan

[73] Assignee: Ricoh Company, Ltd., Tokyo, Japan

[21] Appl. No.: 977,686

[22] Filed: Nov. 24, 1997

Related U.S. Application Data

[63] Continuation of Ser. No. 425,494, Apr. 20, 1995, abandoned.

[30] Foreign Application Priority Data

Jun. 2, 1994 [JP] Japan ..... 6-143957
Jan. 25, 1995 [JP] Japan ..... 7-010148

[51] Int. Cl.[6] ..... B65H 29/00

[52] U.S. Cl. ..... 271/213; 271/207; 271/223; 271/314

[58] Field of Search ..... 271/213, 314, 271/207, 167, 162, 223

[56] References Cited

U.S. PATENT DOCUMENTS

| | | | |
|---|---|---|---|
| 5,008,709 | 4/1991 | Shinada et al. . | |
| 5,096,177 | 3/1992 | Seeki et al. . | |
| 5,211,389 | 5/1993 | Roch et al. | 271/207 |
| 5,308,058 | 5/1994 | Mandel et al. | 271/207 XL |
| 5,328,170 | 7/1994 | Coombs et al. | 271/213 XL |

FOREIGN PATENT DOCUMENTS

| | | | |
|---|---|---|---|
| 263629 | 4/1988 | European Pat. Off. | 271/207 |
| 52142 | 3/1983 | Japan | 271/213 |
| 282256 | 12/1986 | Japan | 271/207 |
| 62-79160 | 4/1987 | Japan . | |
| 62-95373 | 6/1987 | Japan . | |
| 63-116470 | 7/1988 | Japan . | |
| 167169 | 6/1989 | Japan | 271/213 |
| 2-57872 | 4/1990 | Japan . | |
| 88667 | 4/1991 | Japan | 271/314 |
| 39256 | 2/1992 | Japan | 271/223 |
| 4-350056 | 12/1992 | Japan . | |
| 64821 | 3/1994 | Japan | 271/213 |
| 100222 | 4/1994 | Japan | 271/207 |

*Primary Examiner*—Frank E. Werner
*Attorney, Agent, or Firm*—Oblon, Spivak, McClelland, Maier & Neustadt, P.C.

[57] ABSTRACT

An image forming apparatus in which paper fed from a paper feeder is transported to image forming portions. A toner image is formed on the paper, and a pair of paper discharge rollers of a discharge unit are disposed at the rear end of a paper storing unit to discharge the paper into the paper storing unit. Preferably, the paper storing unit is disposed inside of the apparatus, with a lid or panel covering an access opening after the paper discharge operation has been completed, the paper storing unit is withdrawn from the apparatus; and/or feeds a stack of paper outside the apparatus upon opening of the panel. Therefore during the image forming operation, the leakage of noise made in the apparatus is prevented or reduced. Furthermore, since paper is discharged toward the front of the image forming apparatus, the width of the apparatus is minimized.

34 Claims, 13 Drawing Sheets

PAPER DISCHARGE DEVICE AND STORING UNIT FOR IMAGE FORMING APPARATUS

This application is a Continuation of application Ser. No. 08/425,494, filed on Apr. 20, 1995, now abandoned.

BACKGROUND OF THE INVENTION

1. Field of the Invention

The present invention relates to a paper discharge device and storing unit for an image forming apparatus such as a copier, printer, facsimile transceiver or similar image forming apparatus which forms an image on paper. More particularly, the invention is concerned with an image forming apparatus which includes a paper discharge device for discharging a sheet of paper to a paper storing unit located inside the image forming apparatus.

2. Description of the Related Art

Japanese Patent Laid-Open Publication No. 1-236155 discloses a paper discharge device in which a sheet of paper is discharged to a paper storing unit located inside the image forming apparatus. The discharge or feed direction of paper into the unit, however, is perpendicular to the pulling direction (direction of removal) of the unit. As a result, the apparatus requires sufficient space to transport and discharge the sheet of paper into the unit perpendicular to the pull-out or removal direction, thus causing the width dimension of the apparatus to be relatively large. Therefore the apparatus is not suitable for a small image forming apparatus such as a table top, or desk side type apparatus.

SUMMARY OF THE INVENTION

The present invention provides a paper discharge device and storing unit for an image forming apparatus which can solve the aforementioned conventional drawbacks, and thus it is an object of the present invention to provide a paper discharge device and storing unit for an image forming apparatus which reduces width dimension requirements of the apparatus so as to be suitable for table top or desk side use.

It is another object of the present invention to provide a paper discharge device and storing unit for an image forming apparatus which can prevent or reduce the leakage of noise from the image forming apparatus.

It is a further object of the present invention to provide a paper discharge device and storing unit for an image forming apparatus which prevents a third person from seeing the contents of the copy so as to maintain confidentiality.

In order to achieve the above-mentioned objects, according to the present invention an image forming apparatus for forming an image corresponding to an input image includes at least one paper feeder, an image forming section which forms the image on a sheet of paper fed from the paper feeder, a paper transport device for transporting the sheet of paper on which an image is recorded, a paper storing unit located inside of the apparatus and which is drawn out from the apparatus, and a paper discharge roller which discharges the sheet of paper to the paper storing unit, with the paper discharge direction parallel to the drawing direction (direction of removal) of the storing unit. Alternately, the storing unit can be disposed within the apparatus, with the storing unit including a transport device to feed a stack of paper toward an access opening, with the feed direction of the transport device parallel to the discharge direction of paper into the storing unit.

BRIEF DESCRIPTION OF THE DRAWINGS

The above and other objects, features and advantages of the present invention will become apparent from the following detailed description in conjunction with the accompanying drawings in which:

FIG. 11(*b*) is a perspective and segmented view of a portion of a paper discharge device embodying the present invention;

FIG. 11(*c*) is a perspective view of a discharge roller assembly embodying the present invention;

FIG. 18(*b*) is a schematic illustration of an assembly process of the paper guide;

DESCRIPTION OF THE PREFERRED EMBODIMENTS

Figure 2:
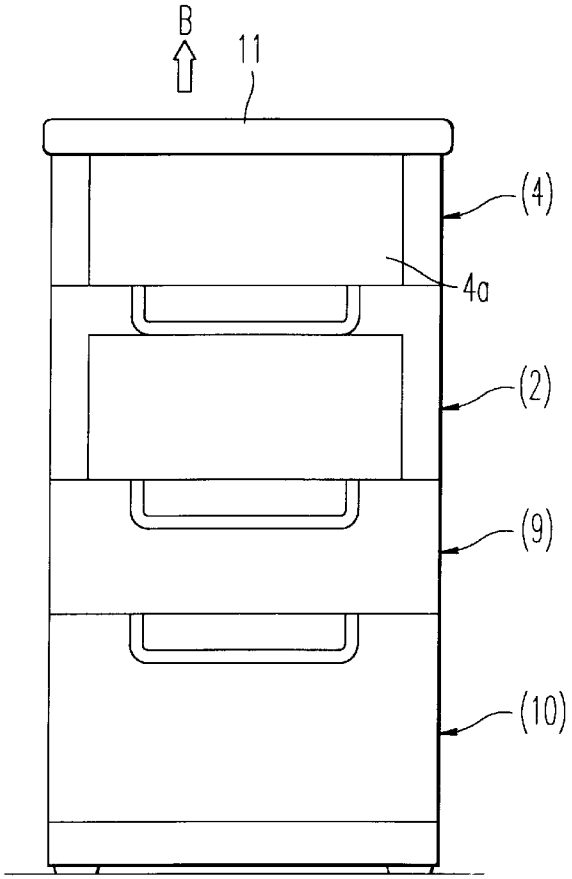
FIG. 2 is a front view of an image forming apparatus embodying the present invention.
Figure 1:
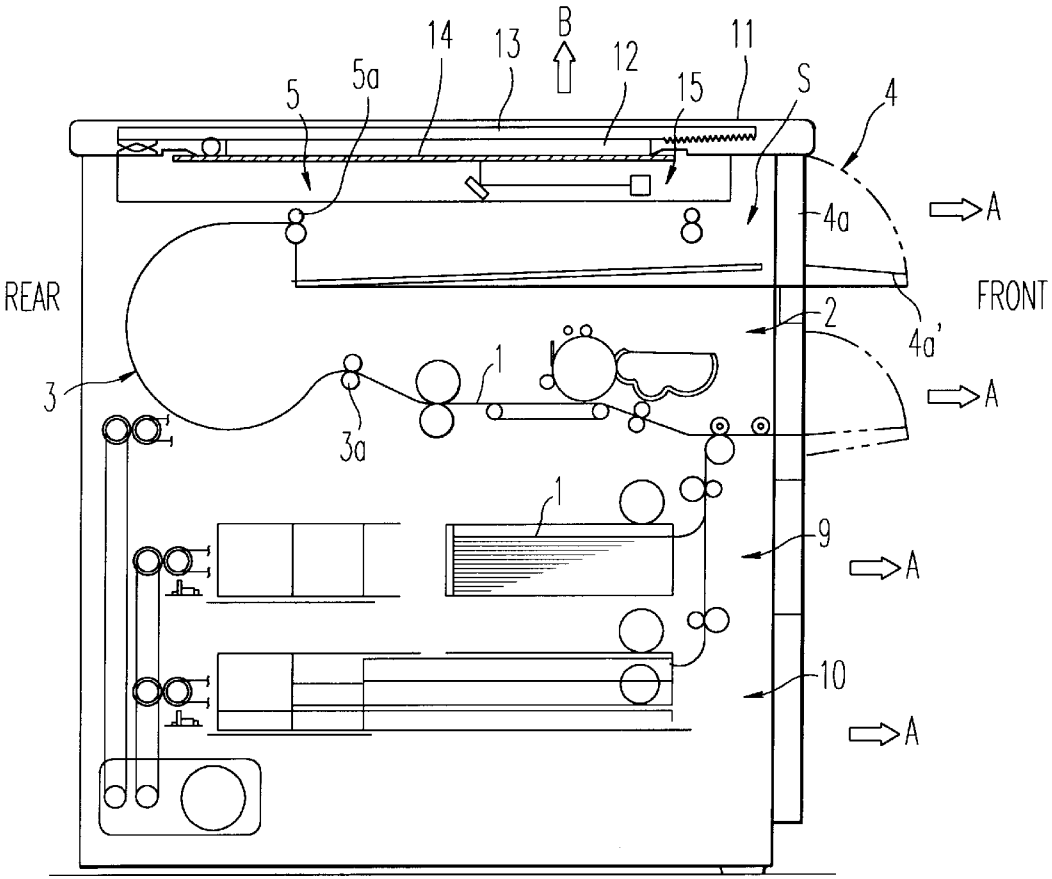
FIG. 1 is a side sectional view of an image forming apparatus embodying the present invention.

Referring now to the drawings, FIG. 1 and FIG. 2 depict an example of a copier embodying the present invention. The copier is shown as a front loading copier in which a paper feed tray is drawn out from and inserted into the front of the copier. Referring to FIG. 1, the device includes an image forming section 2 for forming the image on a sheet of paper 1, a paper transport member or transport guide 3, and a paper discharge unit 5 for discharging the sheet of paper to a paper storing unit 4. The paper storing unit 4, the first paper feed unit 9, and the second paper feed unit 10 can be withdrawn from the front of the copier in a direction indicated by arrow A. The paper discharge unit 5, which is disposed at the back end portion of the paper storing unit 4, discharges the sheet of paper 1 to the storing unit. A lid or housing portion 11 is provided, having sufficient strength to support articles which may be placed upon it, with the lid supported on the copier. A contact plate 13 is disposed under the lid 11.

In operation, the lid 11 and the contact plate 13 are opened, and the document to be copied is placed on the contact glass 14. The document is scanned by scanner 15 in response to operation of a print button on a control panel 4*a* which is located in front of the paper storing unit 4. The control panel 4*a* is covered with a cover 4*a'* which is opened to operate the control panel 4*a*. It is also possible to pivot the control panel 4*a* on an upper end portion of the control panel 4*a* so as to open the paper discharge/storing portion. Of course, it is also possible to provide the control panel at an alternate location.

When the first paper feed unit 9 is selected and the print switch is turned on, the sheet of paper 1 is fed from the first paper feed unit 9. A toner image on the photoconductive drum is transferred to the sheet of paper, and the toner image is then fixed on the paper. The sheet of paper 1 is transported by the paper transport member 3 and is then discharged to the paper storing unit 4. As shown in FIG. 1, the paper storing unit 4 is usually disposed in a space S of the copier, but can be moved between the position in the space S and the withdrawn position outside of the copier. The paper storing unit 4 is drawn out from the space S to take out the stacked paper on the paper storing unit 4. The position of the paper discharge unit 5 is changed according to a discharged paper size, such that the leading edge of each sheet is fed to the front of the storing unit, thereby ensuring a neatly formed stack, and reducing the amount by which the storing unit must be withdrawn to access the stack.

Figure 3:
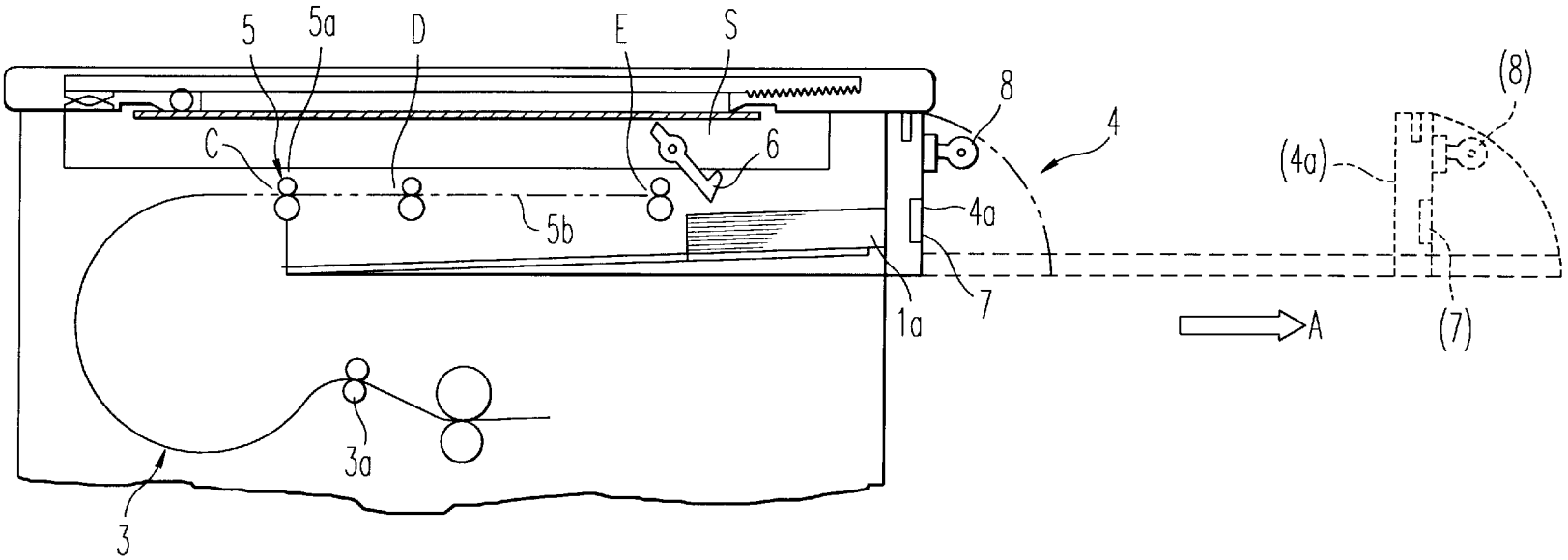
FIG. 3 is a partial side sectional view of a paper discharge device and storing unit embodying the present invention.

Referring to FIG. 3, the paper discharge unit 5 includes discharge rollers 5*a* and a paper guide 5*b*. The paper discharge rollers 5*a* are drawn or moved in the direction indicated by arrow A, and can thereby be variably positioned at, for example, the positions C, D, and E. The position C corresponds to the A3 size, the position D corresponds to the B4 size, and the position E corresponds to the B5 size. The paper guide 5*b* expands and contracts in accordance with the desired movement of the paper discharge rollers of the paper discharge unit 5 to provide positioning of the discharge unit By way of example, the paper discharge rollers 5*a* can be positioned at E, with the paper storing unit 4 located in the space S, and the access opening to the storing unit can be locked by a locking member 8. In this condition, the paper storing unit 4 cannot be withdrawn from the apparatus and is fixed in the space S. Since the paper storing unit 4 is located in the space S and is covered by the control panel 4*a*, noise made in the copier is prevented from escaping, and a third person cannot see the contents of the copy so that confidentiality is maintained.

A detecting member 6 detects the quantity of paper stacked on the paper storing unit 4, and is located adjacent to or contacting the paper stack 1*a*. For the detecting member, a photo interrupter or other sensor is also usable as an alternative to a contact-type detecting member as shown. If the detecting member detects the paper stack 1*a* has reached a predetermined quantity or height, a control unit outputs a signal to finish a copying operation and to operate a warning signal 7. The paper stack 1*a* can then be taken out from the paper storing unit 4 by slightly withdrawing the paper storing unit 4. Large sized paper can also be stacked on the storing unit, with the large sized paper stack removed by more fully withdrawing the storing unit 4 from the apparatus.

Figure 4:
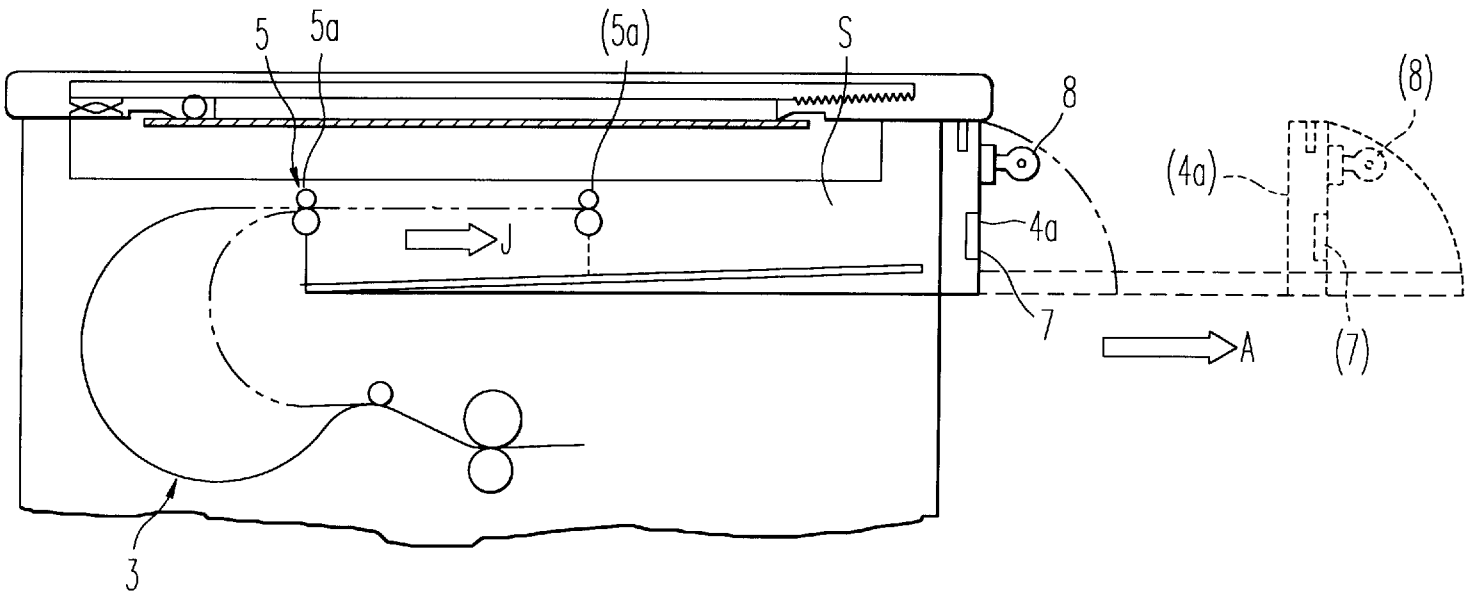
FIG. 4 is a partial sectional view of a modified paper discharge device and storing unit embodying the present invention.

FIG. 4 depicts a modified embodiment of the present invention. Referring to FIG. 4, the paper discharge rollers 5*a* are installed in the paper storing unit 4. If the paper storing unit 4 is withdrawn in the direction indicated by arrow A, the paper discharge rollers 5*a* are moved in a direction indicated by arrow J. The paper transport guide 3 can also be transformed in accordance with the movement of the paper storing unit 4. In this embodiment, since the paper discharge rollers 5*a* are moved in accordance with the movement of the paper storing unit 4, the sheet of paper is discharged toward the front of the copier, so that an operator can easily remove the discharged paper. Thus, with the embodiment of FIG. 4, paper can be discharged into the storing unit 4 whether the storing unit is inside or outside of the copier housing, since the discharge rollers and transport guide 3 move with the storing unit 4. Accordingly, the operator can select whether to utilize the copier with the storing unit inside of the apparatus (e.g., where noise and/or confidentiality are of concern) or outside of the apparatus (e.g., for more convenient access and where noise and/or confidentiality are not a concern).

Figure 5:
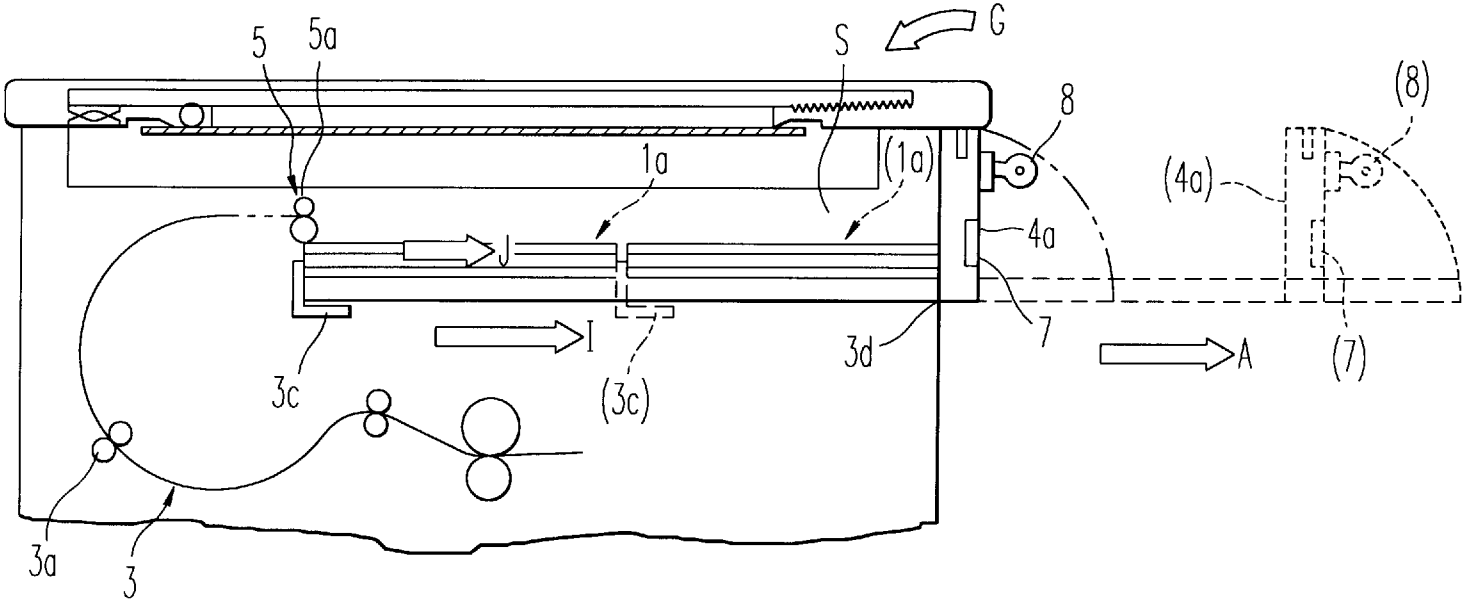
FIG. 5 is a partial sectional view of the modified paper discharge device and storing unit embodying the present invention.

FIG. 5 is another modified embodiment of the invention. Referring to FIG. 5, a moving rail or lug 3*c* is provided under the paper discharge unit 5. After a copying operation is completed (or after a predetermined number of copies has been made) the paper is stored on the paper storing unit 4, the moving rail 3*c* is automatically moved in the direction indicated by arrow I until the front end portion of the stacked paper is coincident with the position 3*d*. In this embodiment, when the moving rail 3*c* is positioned as shown in solid line, all sizes of paper can be discharged. For example, assuming A4 size paper is discharged, the moving rail 3*c* is at the solid line position during the paper discharge operation. After the paper discharge operation has been completed, the moving rail 3*c* is automatically moved in the direction indicated by arrow I. The moving rail 3*c* thus moves the paper stack 1*a* in the direction indicated by arrow J so that the front end portion of the sheet of paper is coincident with the position 3*d*. While the moving rail 3*c* moves, the paper storing unit 4 cannot be withdrawn from the copier. After the moving rail 3*c* is at the dotted line position, the paper storing unit 4 can be withdrawn out from the copier. Therefore the stack is moved to the front portion of the storing unit before the storing unit is withdrawn, and an operator can remove the paper stack without extending their hands into the copier and without withdrawing the storing unit more than necessary.

Figure 6:
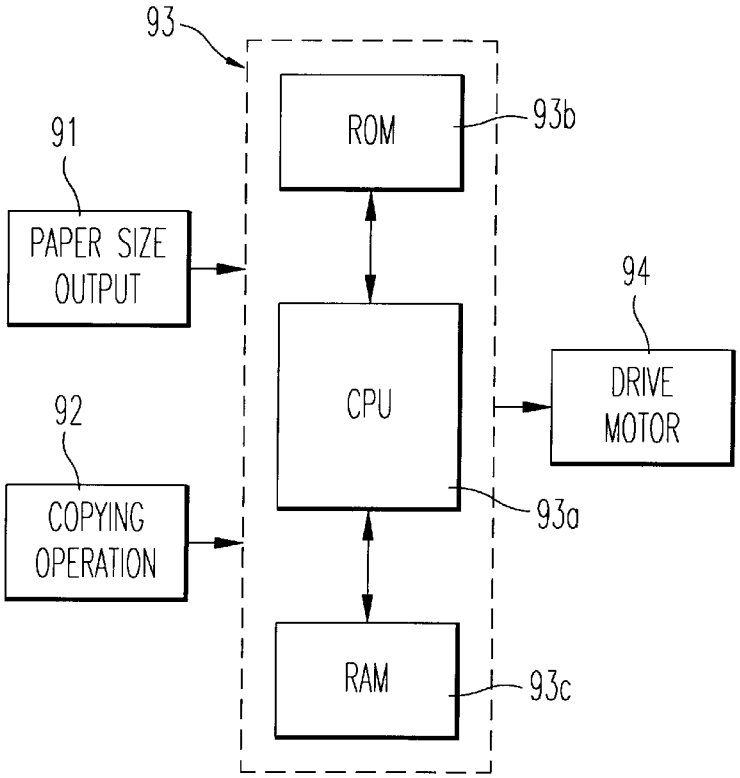
FIG. 6 is a schematic block diagram of control system for the discharge device and storing unit of FIG. 5.

FIG. 6 shows a block diagram of a control device for automatically moving the rail 3*c*. Referring to FIG. 6, a paper size output member 91 outputs a selected paper size signal. When the copying operation is completed, a copying operation member 92 outputs a signal. A control portion 93, which includes a CPU 93*a*, ROM 93*b*, and RAM 93*c*, outputs a control signal to a drive motor 94. The drive motor 94 moves the rail 3*c*, and the driving period of the motor 94 is controlled in response to the selected paper size so that the front end portion of the paper stack 1*a* is coincident with the position 3*d* of FIG. 5.

Figure 7:
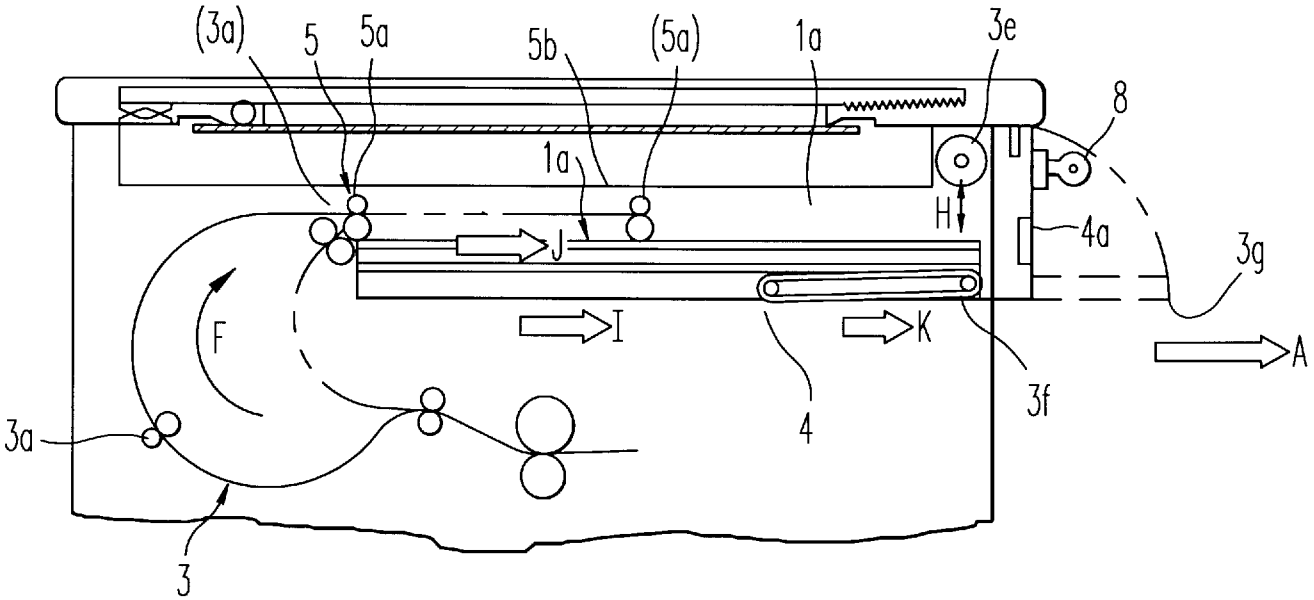
FIG. 7 is a partial sectional view of another modified paper discharge device and storing unit embodying the present invention.

FIG. 7 shows another modified embodiment of the invention. Referring to FIG. 7, an intermediate transport device such as a roller assembly 3*a* is automatically moved in the direction indicated by arrow F in accordance with the selected paper size. The paper discharge unit 5 is also moved in the direction indicated by arrow I in accordance with the selected paper size. In FIG. 7, for example, when paper of the A3 size is discharged, the intermediate transport member 3*a* and the paper discharge unit 5 are positioned as shown in solid line, while during discharge of A4 size paper, they are positioned as shown in dotted line. A paper discharge roller 3*e* and a paper discharge belt 3*f* are positioned at the front portion of the paper storing unit 4. The paper discharge roller 3*e* is automatically moved in the direction indicated by arrow H after a predetermined number of copies is completed (or after the stack reaches a predetermined height). The paper discharge belt 3*f* is disposed such that the front of the belt projects from the upper surface of the paper storing unit 4, and the rear of the belt is positioned below the surface of the unit 4. The paper feed surface (tot surface in FIG. 7) of the belt 3*f* is moved in the direction indicated by an arrow K. After the paper discharge operation has been completed and the control panel or closure panel 4*a* is opened (as shown in dotted line), the paper discharge roller 3*e* and the paper discharge belt 3*f* are automatically operated to move the paper stack 1*a* until the front end of the paper stack is coincident with the position 3*g*. Thus, the closure panel 4*a* can be opened to form a shelf, and the belt 3*f* forwards the stack to the shelf upon completion of a copying operation. According to the FIG. 7 embodiment, the operator can remove the paper stack without extending their hands deeply into the copier. Furthermore, the space in front of the copier required for removing the paper stack is minimized, since the stack is forwarded to the front and at least partially out of the storing unit upon opening of the panel or door 4*a*.

Figure 8:
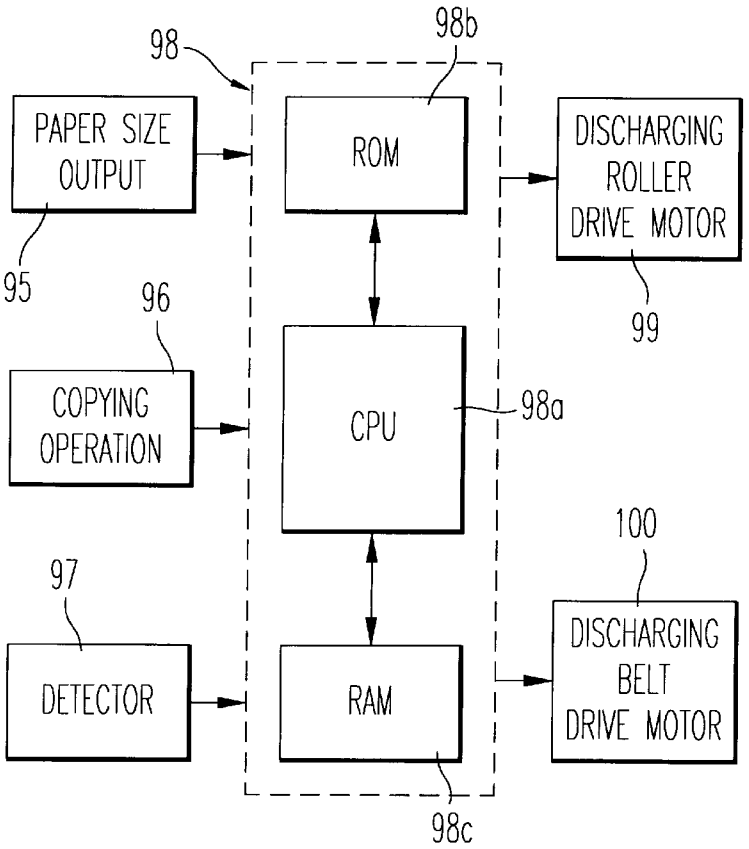
FIG. 8 is a schematic block diagram of a control system for the discharge device and storing unit of FIG. 7.

FIG. 8 shows a block diagram of the control device for automatically moving the paper discharge roller 3*e* and the paper discharge belt 3*f*. Referring to FIG. 8, a paper size output member 95 outputs a selected paper size signal. When the copying operation is completed, a copying operation controller 96 outputs a signal. A control portion 98, which includes a CPU 98*a*, ROM 98*b*, and RAM 98*c*, outputs a control signal to a discharge roller drive motor 99 and a discharge belt drive motor 100. The drive motor 99 moves the discharge roller 3*e* in the direction indicated by arrow H (FIG. 7) when the detector 97 detects the control panel 4*a* is closed. Meanwhile, the drive motor 99 rotates the discharge roller 3*e* for a predetermined period when the detector 97 detects the control panel is opened. The belt drive motor 100 moves the paper discharge belt 3*f* for a predetermined period when the detector 97 detects the control panel 4*a* is opened. The rotation of the roller 3*e* and the movement of the belt 3*f* thus moves the paper stack 1*a*.

Figure 9:
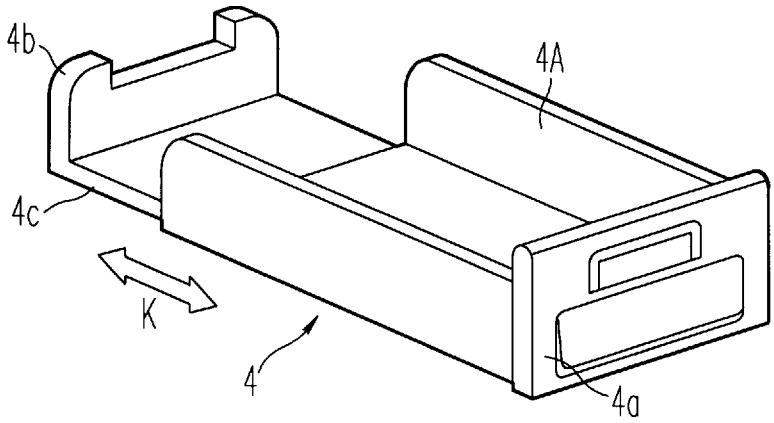
FIG. 9 is a perspective view of a paper storing unit embodying the present invention.

FIG. 9 shows an example of paper storing unit 4. Referring to FIG. 9, the paper storing unit 4 includes a paper storing portion 4A, a back panel 4*b*, and a slider 4*c* which is connected to or integral with the back panel 4*b*. The back panel 4*b* and the slider 4*c* are fixed to the copier and the paper storing portion 4A is moved in a direction indicated by arrow K.

Figure 10:
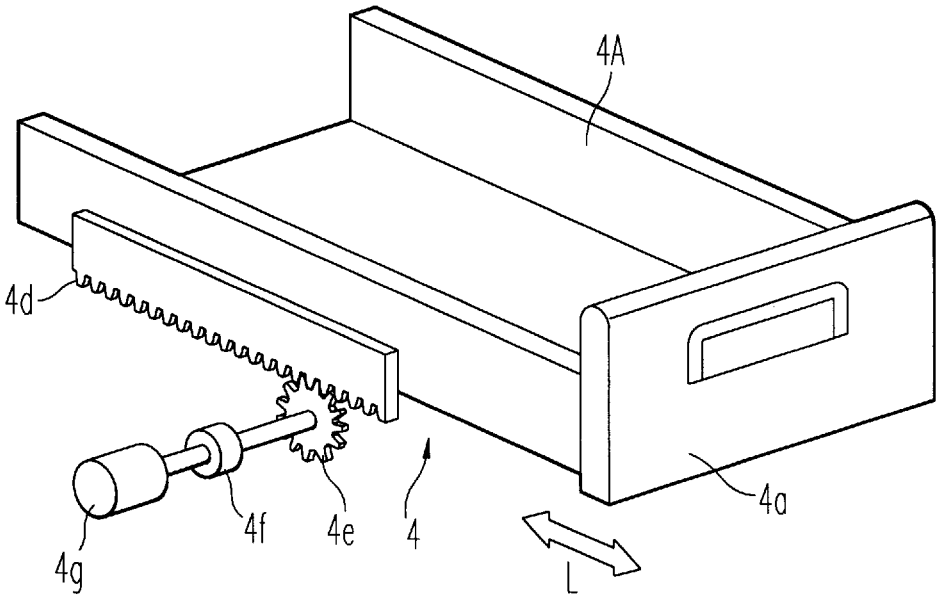
FIG. 10 is a perspective view of a modified paper storing unit embodying the present invention.

FIG. 10 is a modified embodiment of the paper storing unit 4. A rack 4*d* is fixed on the side wall of the body of the paper storing unit 4A. The rack 4*d* is held in mesh with a pinion 4*e*. The pinion 4*e* is driven by a motor 4*g* via a brake or clutch 4*f* so as to move the body 4A in a direction indicated by arrow L. The brake 4*f* is a torque limiter which stops the body 4A (or disengages the drive) when the body 4A hits an obstruction. It is therefore possible to automatically operate the movement of the body 4A in response to the signal of the detecting member 6 (or other sensor) which detects the paper stack on the paper storing unit being filled. According to the present embodiment, automatic withdrawal and safe operation are achieved, since the storing unit can only exert a limited force as it is extending from the copier.

Figure 11A:
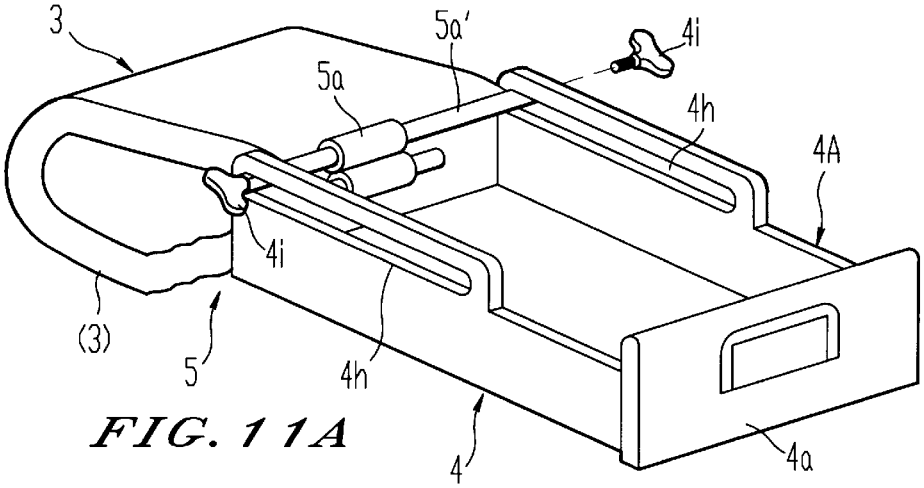
FIG. 11(*a*) is a perspective view of a modified paper storing unit embodying the present invention.
Figure 11B:
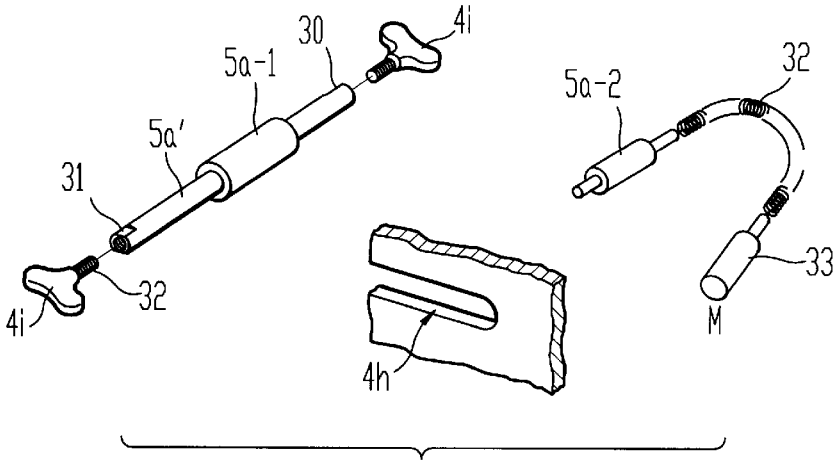
Figure 11C:
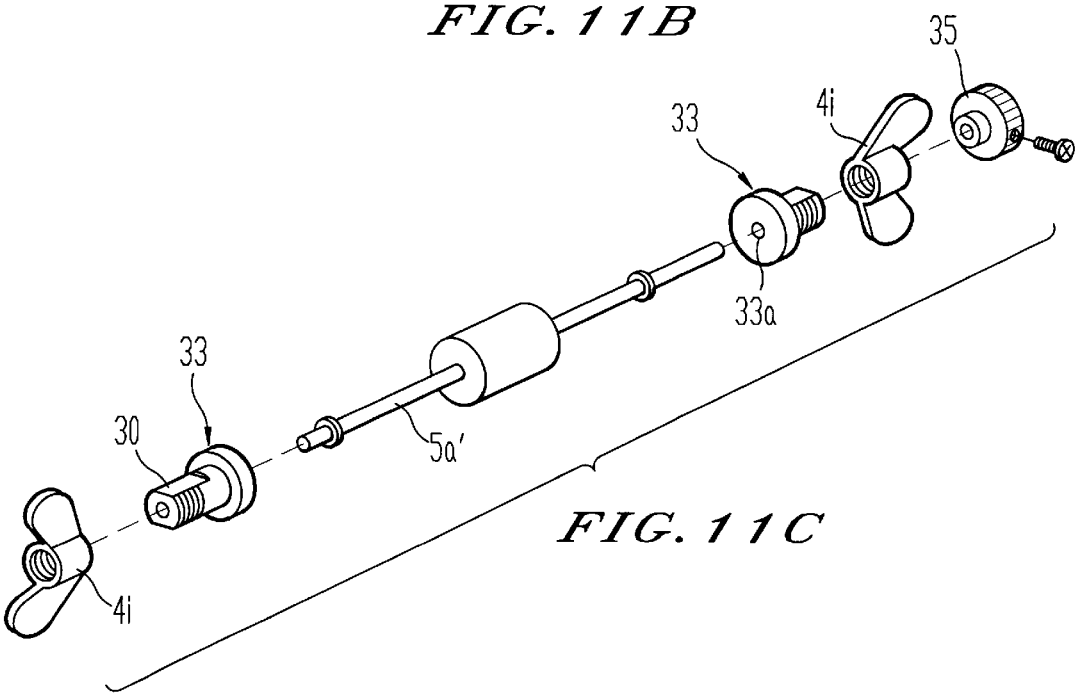

FIGS. 11(*a*), 11(*b*), and 11(*c*) depict additional modifications of the paper discharge and storing units. Referring to FIG. 11(*a*), elongated slots 4*h* are formed on the side walls of the body of the paper storing unit 4A respectively. Both sides of a shaft 5*a*' which supports the paper discharging roller 5*a* for rotation thereon, are received in the elongated slots 4*h*. Both end portions of the shaft 5*a*' are engaged with screws 4*i* so as to fix the shaft 5*a*' to the side walls. The paper discharge device, which comprises the paper discharge rollers 5*a* and the shaft 5*a*', is moved along the slots 4*h* after loosening of the screws 4*i*. The lower roller 5*a* can be mounted for movement with the upper roller, or a separate adjustment slot can be provided. The paper transport member or guide 3 is a flexible member which is moved according to the movement of the paper discharge member. The screw adjustment/fastening arrangement is primarily suitable for uses in which the paper size is changed infrequently, since the screw adjustment arrangement is primarily suitable for manual adjustment of the discharge roller position.

Referring to FIG. 11(*b*), the upper paper discharge roller 5*a*-1 is supported on the shaft 5*a*' so as to rotate the roller 5*a*-1 on the shaft. Flat portions 30 are formed on the surface of both end portions of the shaft 5*a*'. Female screw holes 31 are formed on both end surfaces of the shaft 5*a*'. The female screw holes 31 engage with the male screws 4*i*, so that the shaft 5*a*' is fixed at a predetermined position of the elongated slot 4*h*. Meanwhile, the lower paper discharge roller 5*a*-2 is a drive roller which is driven by a motor 33 via a flexible coupling joint 32.

It is also possible to utilize the upper paper discharge roller 5*a*-1 as a drive roller as shown in FIG. 11(*c*). Referring to FIG. 11(*c*), a bearing 33 is disposed between the screw 4*i* and the shaft 5*a*'. A flat portion 30 is formed on the surface of the bearing 33 and is received in the slot 4*h*. The female screw hole is formed on the surface of the bearing 33, and engages with the screw 4*i* to fix the bearing 33 at a predetermined position along slot 4*h*. A bearing slot 33*a* is formed on another end portion of the bearing 33. The shaft 5*a*' is freely inserted into the slot 33*a*. One end of the shaft 5*a*' penetrates the bearing 33 and the screw 4*i*, and the end portion of the shaft 5*a*' is fixed at a drive gear 35. As a result, the shaft 5*a*' and the paper discharging roller 5*a*-1 are driven by a motor.

Figure 12:
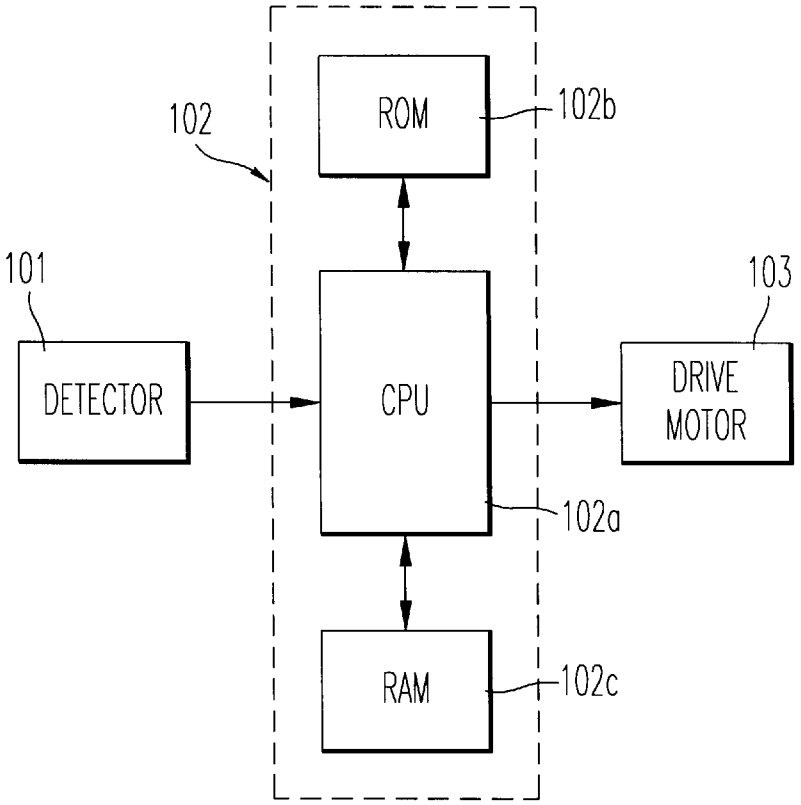
FIG. 12 is a schematic block diagram of a control system for the discharge device embodying the present invention.

The paper storing unit can be automatically withdrawn from the apparatus when the paper stack reaches a predetermined quantity or height. FIG. 12 shows a block diagram of the control device for automatically withdrawing the paper storing unit 4. Referring to FIG. 12, when a detector 101 detects the paper stack has reached a predetermined height or paper quantity, it outputs a detecting signal to a control portion 102. The control portion 102 comprises a CPU 102*a*, ROM 102*b*, and RAM 102*c*. The control portion 102 operates a drive motor 103 in response to the detecting signal so as to move the paper storing unit 4. Thus, the paper storing unit 4 is automatically drawn out from the copier when the quantity of paper reaches a predetermined quantity or the stack reaches a predetermined height. The withdrawal can also automatically operate in response to the completion of a copying operation, if desired.

Figure 13:
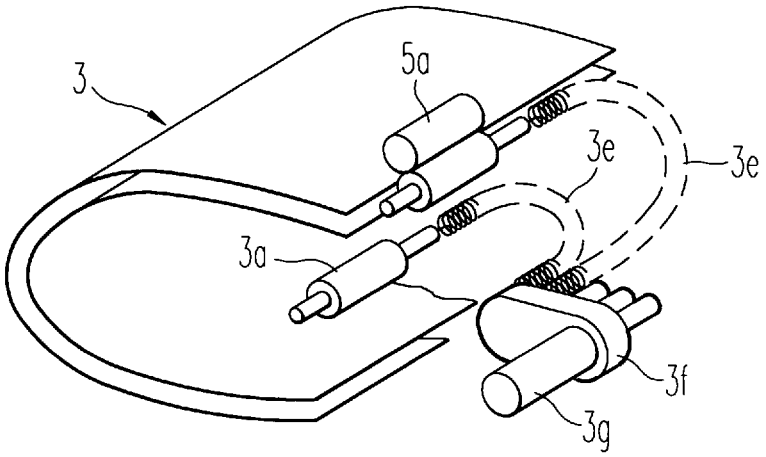
FIG. 13 is a perspective view of a section of the discharge device embodying the present invention.
Figure 14:
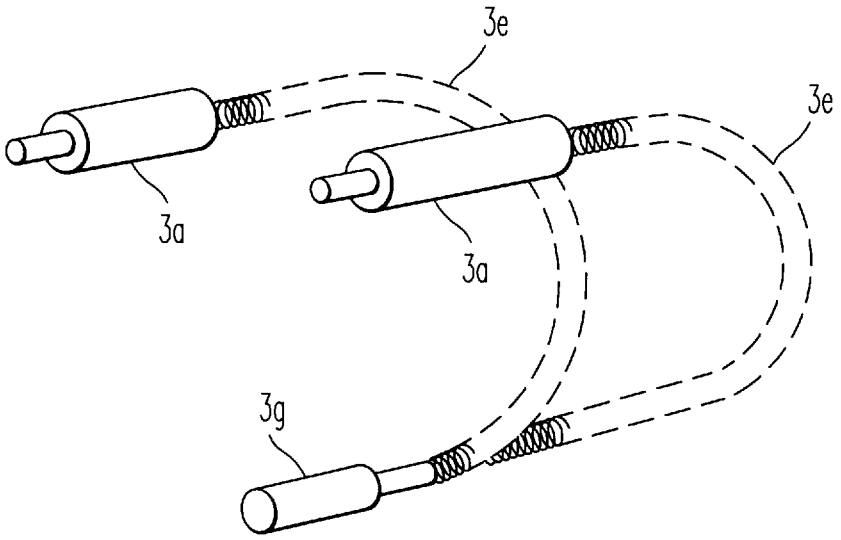
FIG. 14 is a perspective view of a drive system for driving a transport member embodying the present invention.

FIG. 13 shows a structure for driving the intermediate transport member or roller 3*a* (e.g., a roller assembly associated with the guide as shown in FIG. 7), and FIG. 14 shows a structure of a driving unit of the intermediate transport roller. Referring to FIG. 13 and FIG. 14, the intermediate transport roller 3*a* is disposed in the middle of the paper transport path of the paper transport guide 3. The shaft of the intermediate transport roller 3*a* and the shaft of the paper discharge rollers 5*a* are connected to a gearbox 3*f* via flexible joints 13. Rotary power of a drive gear 3*g* which is driven by the motor is transmitted to the rollers 3*a* and 5*a* via the gearbox 3*f* and the flexible joint 13 to rotate the rollers. Since the intermediate transport roller 3*a* and the paper discharge rollers 5*a* are driven by the flexible joints 13, they can follow the transformation of the paper transport guide member 3.

Figure 15:
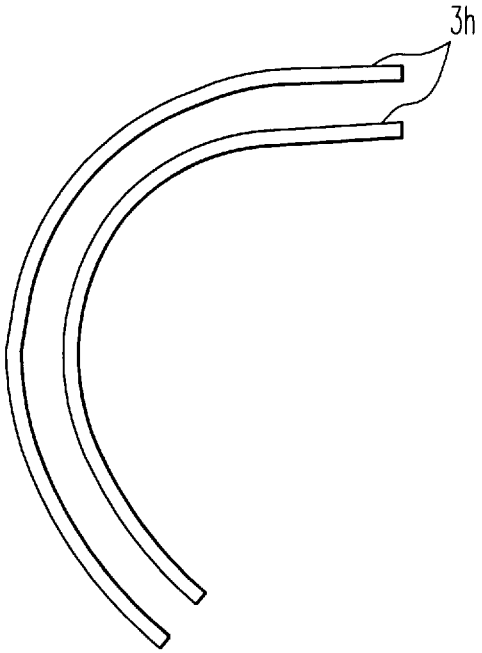
FIG. 15 is a side view of a paper guide embodying the present invention.

FIG. 15 shows an embodiment of the paper transport member or transport guide 3. Referring to FIG. 15, the paper transport guide 3 includes a pair of thin elastic plates 3*h* so as to follow the movement of the paper storing unit 4. Beads can be provided on the surface of the paper transport guide 3 in parallel with the paper transport direction to prevent the sheet of paper from sticking (e.g., by static) to the guide. The plate 3*h* is made, e.g., of thin stainless plate or elastic plastic plate materials.

Figure 16:
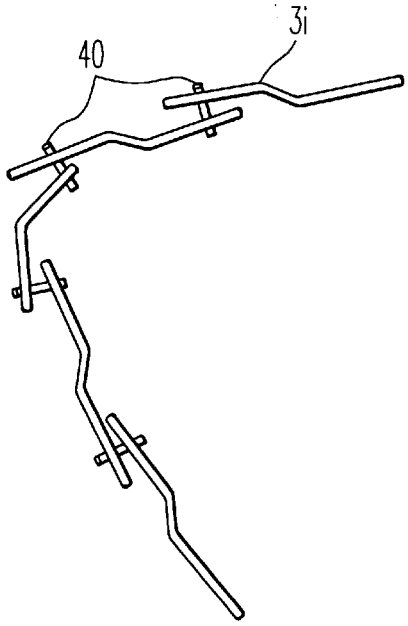
FIG. 16 is a side view of a modified paper guide embodying the present invention.
Figure 17:
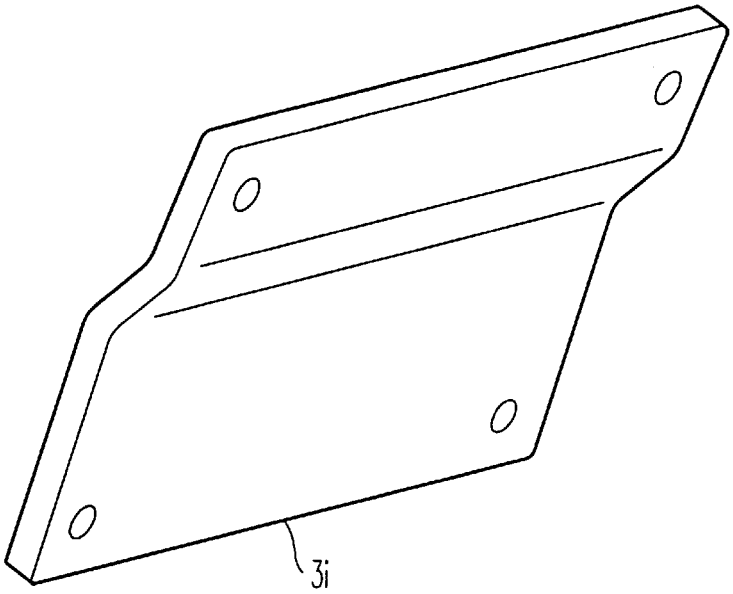
FIG. 17 is a perspective view of a section of the paper guide of FIG. 16.

FIG. 16 and FIG. 17 show a modified embodiment of the paper transport guide 3. The paper transport guide 3 includes a plurality of L shaped plates 3*i*, one of which is shown in FIG. 17. The plates 3*i* are connected by pins 40 outside the paper transport surface of the plate. It is also possible to utilize wire or rivets as the connector instead of the pins. A paper guide member, which includes the plates 3*i* and the pins 40, can thus follow the movement of the paper storing unit 4, with the paper transport member 3 including a pair of the paper guide members. The length of the plate 3*i* is preferably not more than the length of the minimum size of paper with respect to the paper transport direction. It is also possible to form the paper transport guide member 3 as a combination of the paper guide member 3*i* of FIG. 16 and the thin elastic plate 3*h* of FIG. 15.

Figure 18A:
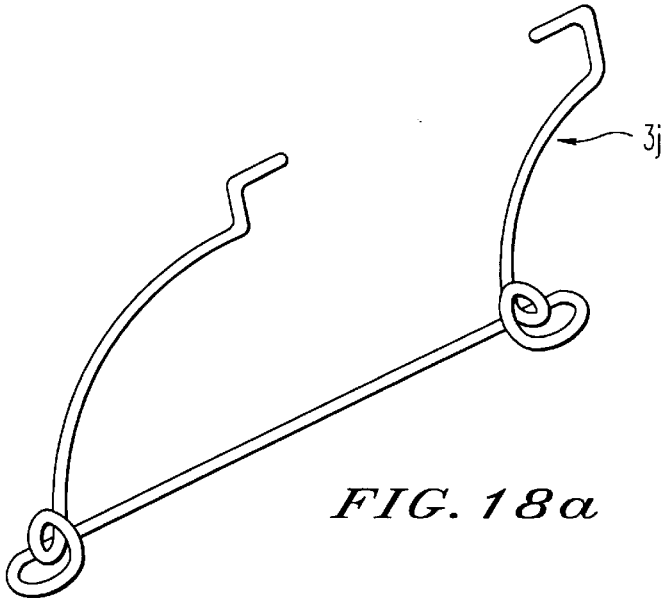
FIG. 18(*a*) is a perspective view of a portion of a modified paper guide embodying the present invention.
Figure 18B:
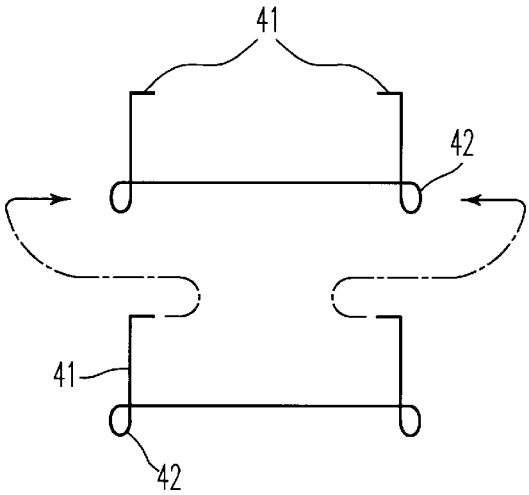
Figure 19:
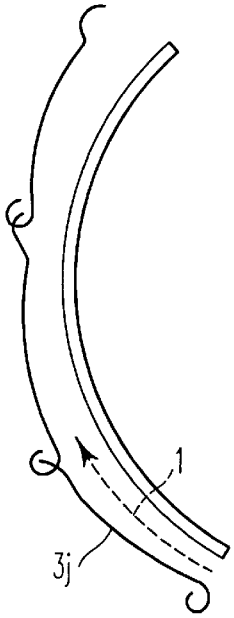
FIG. 19 is a side view of a portion of a paper guide embodying the present invention.

FIGS. 18(*a*), (*b*) and FIG. 19 show another modified embodiment of the paper transport guide 3. Referring to FIG. 18(*a*), the paper transport guide 3 includes a plurality of paper guides 3*j* of bent wire links connected with each other as shown in FIG. 18(*b*). Referring to FIG. 18(*b*), hooks 41 of a paper guide 3*j* are inserted into slots 42 of another paper guide 3*j*, so both of them are fixed to each other. The connected paper guides 3*j* are thus articulated at connected portions so as to follow the movement of the paper storing unit 4. The paper transport member is composed of a pair of the connected paper guides 3*j*. The length of the paper guide 3*j* is preferably not more than the length of the minimum size of paper with respect to the paper transport direction. It is also possible to form the paper transport guide as a combination of connected paper guides 3*j* and the thin elastic plate 3*h* as shown in FIG. 19.

Figure 20:
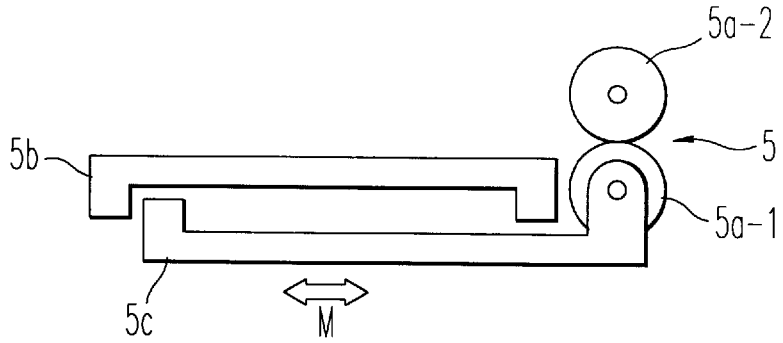
FIG. 20 is a side view of a modified paper transport guide embodying the present invention.

FIG. 20 shows an embodiment of the paper transport guide 5*b* of FIGS. 3, 4 and 7, which provides for the movable positioning of the discharge rollers. Referring to FIG. 20, the transport guide 5*b* includes a first guide plate 5*c* and a second guide plate 5*d*. A paper discharge roller 5*a*-1 (which is one of the paper discharging rollers 5*a*) is supported on the first guide plate 5*c*. The first guide plate 5*c* and the paper discharge roller 5*a*-1 are supported for movement on the side wall of the copier, and both of them are movable as designated by arrow M. Another paper discharge roller 5*a*-2 is supported on the side wall of the copier and moves with the roller 5*a*-1. The second guide plate 5*d* is fixed. According to the present embodiment, the length of the paper transport guide 5*b* and thus the position of the paper discharge roller 5*a* are changed by moving the movable guide plate 5*c* relative to the guide plate 5*d*. Movement of the guide plate 5*c* can be accomplished by known drive arrangements, such as a screw feed, rack and pinion, etc.

Figure 21:
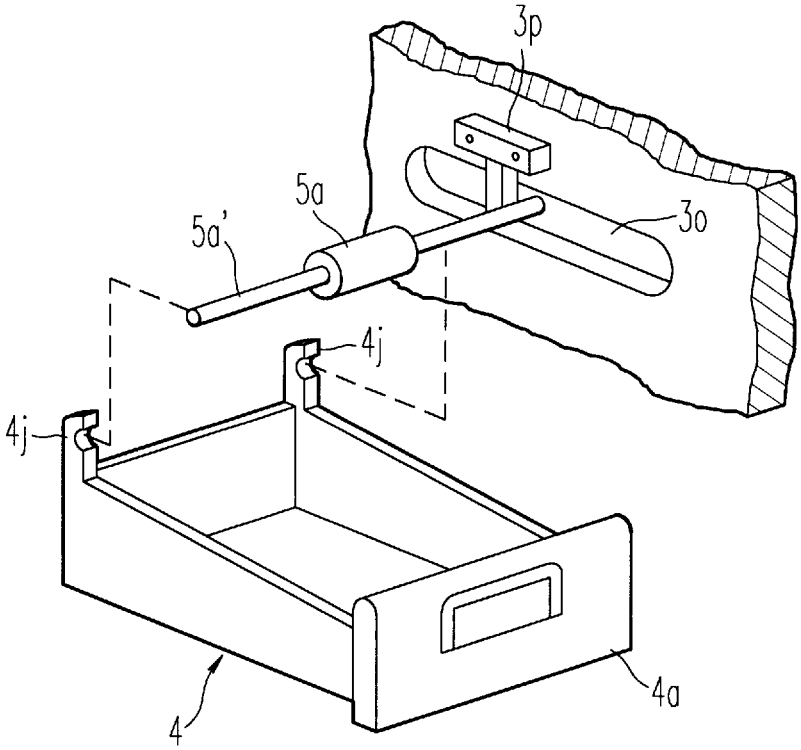
FIG. 21 is a perspective partially sectioned view of a modified discharge device and storing unit embodying the present invention.

FIG. 21 is another modified embodiment of the paper storing unit 4. Referring to FIG. 21, the paper discharge roller 5*a* is supported by the shaft 5*a*' so as to rotate the roller on the shaft. Both sides of the shaft 5*a*' are supported by elongated slots 30 which are formed in side walls of the copier. The shaft 5*a*' is moved along the elongated slots and is engaged with recesses 4*j*. The position of the shaft 5*a*' is also determined by the engagement member 3*p*. The engagement member 3*p* is a T shaped member which is detachably fixed on the side wall of the copier. Thus, the engagement member 3*p* can be positioned at a desired location to define a rearwardmost position of the roller 5*a*, while the recesses 4*j* cause the roller 5*a* to move forwardly as the storing unit is withdrawn.

As should be apparent, various modifications are possible for those skilled in the art in view of the teachings of the present disclosure. It is therefore to be understood that within the scope of the present claims, the invention may be practiced otherwise than as specifically described herein.

What is claimed is as new and is desired to be secured by Letters Patent of the United States is:

1. An image forming apparatus for forming an image corresponding to an input image, comprising:

at least one paper feeder;

an image forming section which forms an image on a sheet of paper fed from said at least one paper feeder;

a paper transport unit which includes a guide and transports said sheet of paper on which an image is recorded;

a paper storing unit which is located inside said apparatus and which is movable to a location outside of the apparatus by withdrawing the paper storing unit from the apparatus in a withdrawal direction; and at least one paper discharge roller which is operatively connected to said guide and discharges said sheet of paper to said paper storing unit in a paper discharging direction which is parallel to the withdrawal direction of said paper storing unit, said paper discharge roller being adapted to move in a direction parallel to said withdrawal direction according to a size of the paper.

2. The apparatus of claim 1, wherein the apparatus has a front portion and the sheet of paper is discharged toward the front portion of said apparatus.

3. The apparatus of claim 1, further comprising a lock which is adapted to lock said paper storing unit inside the apparatus.

4. The apparatus of claim 1, further comprising a control panel which is provided on a front portion of said apparatus.

5. The apparatus of claim 1, wherein said at least one paper feeder is located inside said apparatus and is removable from said apparatus.

6. The apparatus of claim 5, wherein a removal direction of said paper feeder is parallel to the withdrawal direction of said paper storing unit.

7. The apparatus of claim 1, further comprising:

a detector which detects an amount of paper stacked on said paper storing unit.

8. The apparatus of claim 7, further comprising:

warning means for warning that the amount of paper has reached a predetermined amount.

9. The apparatus of claim 7, wherein said paper storing unit is automatically withdrawn from said apparatus when said detector detects the amount of paper has reached a predetermined amount.

10. The apparatus of claim 7, further comprising:

paper stack moving means for moving the paper stack on said paper storing unit toward the front of said apparatus.

11. The apparatus of claim 1, further comprising:

a lid which covers said paper storing unit so as to prevent the leakage of noise.

12. The apparatus of claim 1, further comprising:

a guide which guides paper to said discharge roller assembly, said guide being movable and deformable to move and deform upon movement of said discharge roller assembly.

13. The apparatus of claim 1, further comprising:

a panel which opens and closes an access opening providing access from outside of the image forming apparatus to said paper storing unit.

14. An image forming apparatus for forming an image corresponding to an input image, comprising:

at least one paper feeder;

an image forming section which forms an image on a sheet of paper fed from said at least one paper feeder;

a paper transport unit which includes a guide and transports said sheet of paper on which an image is recorded;

a paper storing unit which is located inside said apparatus and which is movable to a location outside of the apparatus by withdrawing the paper storing unit from the apparatus in a withdrawal direction; and at least one paper discharge roller which is operatively connected to said guide and discharges said sheet of paper to said paper storing unit in a paper discharging direction which is parallel to the withdrawal direction of said paper storing unit, said paper discharge roller being adapted to move together with said paper storing unit in a direction parallel to said withdrawal direction.

15. The apparatus of claim 14, wherein said paper discharge roller is supported on said paper storing unit.

16. An image forming apparatus for forming an image corresponding to an input image, comprising:

at least one paper feeder;

an image forming section which forms an image on a sheet of paper fed from said at least one paper feeder;

a paper storing unit which is located inside the apparatus and which is movable to a location outside of the apparatus by withdrawing the paper storing unit from the apparatus in a withdrawal direction in order to facilitate removal of the paper from the storing unit;

a paper transport unit which is connected to said paper storing unit and transports to said paper storing unit said sheet of paper on which an image is recorded, said paper transport unit having a pair of paper guides which are flexible and deformable in response to movement of said paper storing unit; and at least one paper discharge roller which discharges said sheet of paper to said paper storing unit in a paper discharging direction which is parallel to the withdrawal direction of said paper storing unit.

17. The apparatus of claim 16, wherein said pair of paper guides comprises a thin elastic plate.

18. The image forming apparatus of claim 17, wherein said discharge roller is movable relative to said paper storing unit according to a size of the paper such that a leading edge of the paper discharged to said paper storing unit is fed to a front of said paper storing unit.

19. The apparatus of claim 16, wherein at least one of said pair of paper guides includes a plurality of bent wires which are connected with each other.

20. The apparatus of claim 16, wherein at least one of said pair of paper guides includes a plurality of L shaped plates which are connected with each other.

21. The apparatus of claim 16, wherein at least one of said pair of paper guides includes a plurality of bent wires which are connected with each other.

22. A paper discharging device which is located inside an image forming apparatus including an image forming section for forming an image on a sheet of paper and a paper storing unit withdrawable from the apparatus in a withdrawal direction, comprising:

a paper transport unit which includes a guide and transports the sheet of paper from the image forming section to the paper storing unit; and a pair of paper discharge rollers which are operatively connected to said guide and discharges the sheet of paper in the paper storing unit along a discharging direction, said paper discharge rollers being adapted to move in a direction parallel to the withdrawal direction according to a size of the paper.

23. The apparatus of claim 22, wherein the apparatus has a front portion and the sheet of paper is discharged toward the front portion of said apparatus.

24. An image forming apparatus for forming an image on recording paper, comprising:

at least one paper feeder which can be withdrawn out from said apparatus at a front of said apparatus;

an image forming unit which forms an image on said recording paper;

a paper transport unit which includes a guide and transports said recording paper;

a paper tray;

a paper tray support unit which supports said paper tray inside said apparatus movably in a withdrawal direction; and a paper discharge unit which discharges said paper into said paper tray in a discharge direction parallel to said withdrawal direction and which includes at least one paper discharge roller which is operatively connected to said guide and is adapted to move in a direction parallel to the withdrawal according to a size of the paper.

25. An image forming apparatus comprising:

at least one paper feeder for feeding paper upon which an image is to be formed;

an image forming section which forms said image on paper fed by said paper feeder;

a paper storing unit which receives the paper having the image formed thereon in said image forming section, said paper storing unit disposed inside of a housing of said image forming apparatus;

a discharge roller assembly for discharging paper into said paper storing unit in a discharge direction such that after an image is formed on paper in said image forming section, said paper is successively discharged into said paper storing unit to form a stack of paper in said paper storing unit; and said paper storing unit including a motive means which moves the stack of paper in a direction parallel to said discharge direction to facilitate vertical alignment of the stack.

26. An image forming apparatus of claim 25, further comprising:

a panel which opens and closes an access opening providing access from outside of the image forming apparatus to the paper storing unit.

27. The image forming apparatus of claim 26, further comprising:

a lock for locking said panel.

28. The image forming apparatus of claim 25, further comprising:

a paper guide which guides paper to said discharge roller assembly, said paper guide being movable and deformable to move and deform upon movement of said discharge roller assembly.

29. The image forming apparatus of claim 25, further comprising:

a device which movably mounts said paper storing unit such that at least a portion of said paper storing unit is movable outside of the housing in a first direction, with said first direction parallel to said discharge direction.

30. An image forming apparatus comprising:

at least one paper feeder for feeding paper upon which an image is to be formed;

an image forming section which forms an image on paper fed by said paper feeder;

a paper storing unit which receives paper having images formed thereon in said image forming section, said paper storing unit disposed inside of a housing of said image forming apparatus and including a device which mounts said paper storing unit movably in a withdrawal direction;

a guide through which the sheet of paper is transported from said image forming section to said paper storing unit;

a discharge roller assembly for discharging paper from said image forming section into said paper storing unit in a discharge direction such that said paper is successively discharged into said paper storing unit to form a stack of paper in said paper storing unit after an image is formed on paper in said image forming section, said discharge roller assembly being operatively connected to said guide and adapted to move in a direction parallel to the withdrawal direction according to a size of the paper.

31. An image forming apparatus of claim 30, further comprising:

a panel which opens and closes an access opening providing access from outside of the image forming apparatus to the paper storing unit.

32. The image forming apparatus of claim 31, further comprising:

a lock for locking said panel.

33. The image forming apparatus of claim 30, further comprising:

a paper guide which guides paper to said discharge roller assembly, said paper guide being movable and deformable to move and deform upon movement of said discharge roller assembly.

34. An image forming apparatus comprising:

at least one paper feeder for feeding paper upon which an image is to be formed;

an image forming section which forms an image on paper fed by said paper feeder;

a paper storing unit which receives paper having images formed thereon in said image forming section, said paper storing unit disposed inside of a housing of said image forming apparatus and including a device which mounts said paper storing unit movably in a withdrawal direction;

a guide through which the sheet of paper is transported from said image forming section to said paper storing unit;

a discharge roller assembly for discharging paper from said image forming section into said paper storing unit in a discharge direction such that said paper is successively discharged into said paper storing unit to form a stack of paper in said paper storing unit after an image is formed on paper in said image forming section, said discharge roller assembly being operatively connected to said guide and adapted to move in a direction parallel to the withdrawal direction, said discharge roller assembly being mounted on said paper storing unit such that said discharge roller assembly discharges paper into said paper storing unit both when said paper storing unit is inside of said housing and when said paper storing unit is at least partially withdrawn from said housing.

* * * * *